US009718073B2

(12) United States Patent
Kang

(10) Patent No.: US 9,718,073 B2
(45) Date of Patent: Aug. 1, 2017

(54) PUMP FOR DISCHARGING CONTENTS

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 0 days.

(21) Appl. No.: 15/101,413

(22) PCT Filed: Jan. 23, 2014

(86) PCT No.: PCT/KR2014/000643
§ 371 (c)(1),
(2) Date: Jun. 2, 2016

(87) PCT Pub. No.: WO2015/083891
PCT Pub. Date: Jun. 11, 2015

(65) Prior Publication Data

US 2016/0303601 A1 Oct. 20, 2016

(30) Foreign Application Priority Data

Dec. 3, 2013 (KR) ..... 10-2013-0149507

(51) Int. Cl.
*B05B 11/00* (2006.01)
*A45D 34/00* (2006.01)
(Continued)

(52) U.S. Cl.
CPC ..... *B05B 11/3025* (2013.01); *A45D 33/025* (2013.01); *A45D 34/00* (2013.01);
(Continued)

(58) Field of Classification Search
CPC ..... B05B 11/3025; B05B 11/3033; B05B 11/0048; A45D 33/025; A45D 34/00; A45D 2200/056; F04B 53/14; F04B 19/22
(Continued)

(56) References Cited

U.S. PATENT DOCUMENTS 5,664,703 A * 9/1997 Reifenberger ..... B05B 11/0016 222/207
7,523,844 B2 * 4/2009 Garcia ..... B05B 1/3436 222/321.2
(Continued)

FOREIGN PATENT DOCUMENTS

FR EP 1939111 A1 * 7/2008 ..... B05B 11/0072
JP 2009-119232 6/2009
(Continued)

*Primary Examiner* — Donnell Long
(74) *Attorney, Agent, or Firm* — East West Law Group; Heedong Chae

(57) ABSTRACT

The present invention relates to a pump for discharging contents, in which a pump upper body having contents outlets formed therein is inserted into the upper part of a pump main body having a contents inlet formed therein, a pump inner body is fitted into the inside of the pump main body and the pump upper body, the pump inner body integrally includes the serving as a temporary content reservoir for temporarily storing the contents, a suction valve plate for sucking the contents, and a discharge valve protruding ring for discharging the contents, and thus the contents are discharged as the volume of the temporary content reservoir in the pump inner body is changed by vertically moving the pump upper body relative to the pump main body.

14 Claims, 20 Drawing Sheets

(51) Int. Cl.
*F04B 19/22* (2006.01)
*F04B 53/14* (2006.01)
*A45D 33/02* (2006.01)

(52) U.S. Cl.
CPC ..... *B05B 11/3033* (2013.01); *F04B 19/22* (2013.01); *F04B 53/14* (2013.01); *A45D 2200/056* (2013.01); *B05B 11/0048* (2013.01)

(58) Field of Classification Search
USPC ..... 222/383.1, 207
See application file for complete search history.

(56) References Cited

U.S. PATENT DOCUMENTS

| | | | | |
|---|---|---|---|---|
| 2007/0045347 | A1* | 3/2007 | Auer | B05B 11/3035 222/207 |
| 2010/0116849 | A1* | 5/2010 | Lautre | B05B 11/0029 222/153.13 |
| 2012/0024904 | A1* | 2/2012 | Doulin | B05B 11/3035 222/207 |
| 2014/0103071 | A1* | 4/2014 | Park | A45D 34/00 222/207 |

FOREIGN PATENT DOCUMENTS

| | | |
|---|---|---|
| KR | 10-0647455 | 11/2006 |
| KR | 20-2009-0002806 | 3/2009 |
| KR | 10-2010-0128968 | 12/2010 |
| KR | 20-2011-0007033 | 7/2011 |
| KR | 20-0461242 | 7/2011 |
| KR | 10-1150776 | 6/2012 |

* cited by examiner

Prior Art

Prior Art

Prior Art

Prior Art

Prior Art

PUMP FOR DISCHARGING CONTENTS

CROSS-REFERENCE TO RELATED APPLICATION

This application claims the benefit of Korean Application No. 10-2013-0137515, filed on Nov. 13, 2013 with the Korean Intellectual Property Office, the disclosure of which is incorporated herein by reference.

TECHNICAL FIELD

The present invention relates to a pump for discharging contents, which is mounted on a container containing the contents and is used to allow a user to discharge the contents from the container by a predetermined amount at a time by a pumping operation and to use the discharged contents. More particularly, the present invention relates to a pump for discharging contents, in which a pump upper body having contents outlets formed therein is inserted into the upper part of a pump main body having a contents inlet formed therein, a pump inner body is fitted into the inside of the pump main body and the pump upper body, the pump inner body integrally includes an inner body barrel serving as a temporary content reservoir for temporarily storing the contents, a suction valve plate for sucking the contents, and a discharge valve protruding ring for discharging the contents, and thus the contents are discharged as the volume of the temporary content reservoir in the pump inner body is changed by vertically moving the pump upper body relative to the pump main body. Accordingly, since the structure of the pump for discharging contents is simplified, the pump for discharging contents can increase the productivity of products and reduce the unit cost of products, and thus can improve product competitiveness. At the same time, since pumping is performed by changing the volume of the temporary content reservoir through deformation of the inner body barrel, the pump for discharging contents can be easily used in a product in which a discharge pump has a short working stroke and thus a space in which to mount the discharge pump is small, such as a flat compact-type gel foundation container.

BACKGROUND ART

In general, as a means for dispensing a suitable amount of contents, such as cosmetics, shampoo, or detergent, contained in a container, a dispensing pump is mounted on a container for use.

The dispensing pumps according to the related art, which are mounted on a container and used to dispense a small amount of contents as described above, have been variously proposed. As shown in FIG. 1, an opening and closing ball 122 and an operating piston 123 for opening or closing a contents inlet 125 are elastically supported by a spring 121, and a cylinder 120 for allowing the contents in a contents storing chamber 126 to be dispensed through a push button 140 by generating pressure in the contents storing chamber 126 using the operating piston 123 are installed in a pump main body 110.

An air-tight piston 124 is further installed to the operating piston 123 and the push button 140 is installed in an operating tube 130 coupled to the operating piston 123 of the cylinder 120.

According to the above-described contents dispensing pump of the related art, when the push button 140 is pushed, an air gap is generated between the air-tight piston 124 and the operating piston 123. In this case, a pressure is generated in the contents storing chamber 126 while the air-tight piston 124 and the operating piston 123 together move down, so that the contents are dispensed through a contents transferring passage 123*a* of the operating piston 123 due to the pressure.

In this case, the opening and closing ball 122 is tightly closed to a contents introducing passage 125 by the compressed spring 121 so that the contents introducing passage 125 is closed.

After the push button 140 is pushed to dispense contents as described above, when the pushed button 140 is released from the external force applied thereto, as shown in FIG. 2, the operating piston 123 and the air-tight piston 124 may move up together due to the repulsive elastic force accumulated in the spring 121.

At the initial lifting stage of the operating piston 123 and the air-tight piston 124 ascending as described above, while the air-tight piston 124 is stopped ascending due to the friction with an inside of the cylinder 120, the operating piston 123 first moves up to close the air gap between the operating piston 123 and the air-tight piston 124, so that the contents transferring passage 123*a* is closed.

In the state that the contents transferring passage 123*a* is shut off, when the operating piston 123 and the air-tight piston 124 are continuously lifted up, a vacuum pressure is generated in the contents storing chamber 125 and the opening and closing ball 122 is spaced apart from the contents introducing hole 125 due to the vacuum pressure generated in the contents storing chamber 126, so that the contents in the container are introduced into the contents storing chamber 126.

The contents dispensing pump according to the related art dispenses the contents while repeatedly performing the above-described operation.

However, the contents dispensing pump has a major drawback that, since a metallic ball and metallic spring are used as the opening and closing means for dispensing contents, the metallic ball and metallic spring are corroded due to chemical reaction with the contents so that the contents are polluted. In addition, since synthetic resin and metal are used as materials of the contents dispensing pump, when the used contents dispensing pump is discarded, it is difficult to separate the synthetic resin and metallic materials from each other, so that it is difficult to perform resource recycling.

Further, the structure of the contents dispensing pump according to the related art is complex, so that the productivity is deteriorated and the product price is increased. Specifically, since the dispensing pump structurally has a long working stroke distance, when the dispensing pump is applied to a product such as a compact having a height smaller than a width, it is difficult to mount the dispensing pump on the product due to a small mounting space.

To solve the problem, as shown in FIGS. 3 to 5, applicant of the present invention has suggested a contents dispensing pump disclosed in Korean Patent Application No. 10-2013-0069816, wherein a pumping operation is performed by changing the volume of a temporary contents reservoir TR due to a deformation of a deformed pressing member 260. Thus, a working stroke distance of the contents dispensing pump can be short so that the contents dispensing pump can be readily installed in a product where a mounting space for the contents dispensing pump is small.

In the contents dispensing pump coupled to a container 210 for containing the contents therein to dispense the contents, a deformed pressing member 260 descends by being pressed and deformed when a push button 250 descends such that the volume of a temporary reservoir TR in a pump main body 220 including a pump upper body 222 and a pump lower body 224 is reduced and pressure is generated in the temporary reservoir TR. Thus, a valve plate 240 closes a contents inlet 226, and a valve protrusion wheel 262 coming into close contact with a contents opening and closing piece 252 is widened by the pressure such that the contents contained in the temporary reservoir (TR) are dispensed through an outlet 254 while passing through a gap between the contents opening and closing piece 252 and the valve protrusion wheel 262.

Then, when the pressure that presses the push button 250 is removed, while the push button 250 lifts up by a restoring force of an elastic member 270, the deformed pressing member 260 pressed by the push button 250 is restored to the original state. Thus, the pressure generated within the temporary reservoir TR disappears and vacuum pressure is generated, so that the gap between the contents opening and closing piece 252 and the valve protrusion wheel 262 of the deformed pressing member 260 is closed and the central part of the valve plate 240 is lifted by the vacuum pressure to widen boundary lines of opening and closing lines 241. Thus, the contents contained in the container 210 move to the temporary reservoir TR through a gap between the valve plate 240 and the contents outlet 242, and in this case, the contents that have passed through the contents outlet 242 move to the temporary reservoir TR through gaps of the widened opening and closing lines 241 of the valve plate 240. When the contents are transferred so that the vacuum pressure of the temporary reservoir TR disappears, the opening and closing line 241 opened due to the autonomous elastic force is restored to the original state to be closed so that the valve plate 240 closes the contents inlet 226.

However, although the dispensing pump of the related art has an advantage that the pumping is performed by changing the volume of the temporary reservoir TR through the deformation of the deformed pressing member 260, so the working stroke distance of the dispensing pump can be shortened, so that the dispensing pump can be installed in a product where the mounting space for the dispensing pump is small, the dispensing pump of the related art has the structure including various components, such as the push button 250, the pump upper body 222, the pump lower body 224, the deformed pressing member 260 and the valve plate 240, so the assembling productivity may be lowered and the product cost may be increased, degrading the market competitiveness.

DISCLOSURE

Technical Problem

The present invention has been suggested to solve the problems described above, and an object of the present invention is to provide a pump for discharging contents, in which a pump inner body serves as a pump cylinder as well as a suction valve and a dispensing valve, so the number of components can be minimized, so that the assembling productivity can be improved and the product cost can be reduced, thereby providing the pump for discharging contents having the high market competitiveness.

Another object of the present invention is to provide a pump for discharging contents, in which a pump operation is performed by changing a volume of a contents temporary reservoir by folding and unfolding an inner body barrel of a pump inner body, so the pump has a short working stroke distance, so that the pump can be easily applied to a product such as a compact having a short height.

Still another object of the present invention is to provide a pump for discharging contents, in which components making contact with the contents, such as a suction valve or a dispensing valve, are formed of materials durable against the chemical composition instead of metallic materials to prevent corrosion caused by the contents, thereby extending the product life cycle and preventing the contents from being spoiled caused by chemical reaction between the contents and the components.

Technical Solution

To achieve the objects, according to the present invention, there is provided a pump for discharging contents, which is coupled to a container for containing contents therein to dispense the contents, in which the pump includes a pump main body (10), a pump upper body (20), a pump inner body (30) and an elastic member (40).

The pump main body (10) includes a main body sidewall (11) and a main body lower plate (12). The pump main body (10) has a bowl shape where an upper portion is open and an inner portion is empty and a contents inlet (13) is formed at a center of the main body lower plate (12). The main body lower plate (12) is provided at an upper edge thereof with a first inner body latching sill (14) coupled with the pump inner body (30). The main body sidewall (11) is formed at an inner upper end thereof with a first latching sill (15) coupled with the pump upper body (20) to prevent the pump upper body (20) from being separated.

The pump upper body (20) is coupled to an upper portion of the pump main body (10) to move up and down with respect to the pump main body (10). A contents outlet (23) is formed at a center of an upper body upper plate (21), a dispensing valve protrusion wheel (24) is formed under the contents outlet (23), and a connection port (23-1) is formed between the pump upper body (20) and the contents outlet (23) to connect the dispensing valve protrusion wheel (24) with the upper body upper plate (21). In addition, an inner body pressing protrusion wheel (25) is formed under the upper body upper plate (21) while being spaced apart from the dispensing valve protrusion wheel (24) by a predetermined distance. A valve blade operating space (29) is formed between the dispensing valve protrusion wheel (24) and the inner body pressing protrusion wheel (25). An upper body sidewall (26) is provided outward under the upper body upper plate (21). A second latching sill (27) is provided outward from a lower end of the upper body sidewall (26) and latched with the first latching sill (15) of the pump main body (10) and a second inner body latching sill (28) is provided at an upper inner portion of the upper body sidewall (26) and coupled with the pump inner body (30).

The pump inner body (30) is coupled to insides of the pump main body (10) and the pump upper body (20). An inner body barrel (31) having a jar shape is formed at a center of the pump inner body (30). A dispensing valve blade (32) is formed at an upper end of the pump inner body (30) and a suction valve plate (34) connected to an elastic piece (33) is formed at a lower inner side of the inner body barrel (31). A lower side surface extension piece (35) is provided at an outer lower portion of the inner body barrel (31). In addition, a connection piece (36) is integrally formed at an outer portion of the inner body barrel (31), an upper body coupling piece (37) is integrally formed upward from an outer end of the connection piece (36), and an upper side surface extension piece (38) is formed at an outer upper end of the upper body coupling piece (37).

The elastic member (40) is mounted inside the pump main body (10) and the pump upper body (20) to elastically support between the pump main body (10) and the pump upper body (20). After a lower side surface extension piece (35) of the pump inner body (30) is coupled to the pump main body (10), one end of the elastic member (40) is mounted on the lower side surface extension piece (35) of the pump inner body (30). In addition, after an upper side surface extension piece (38) of the pump inner body (30) is coupled to the pump upper body (20), one end of the elastic member (40) is elastically supported on the upper side surface extension piece (38).

Further, a recess section (22) having a bowl shape is formed at a center of the pump upper body (20), the contents outlet (23) is formed at an upper side portion of the recess section (22), and the dispensing valve protrusion wheel (24) is formed under the contents outlet (23).

In addition, an auxiliary dispensing valve member (50) is coupled to the recess section (22) of the pump upper body (20). The auxiliary dispensing valve member (50) is provided at an upper outer peripheral surface thereof with an auxiliary dispensing valve blade (51) and formed at a lower center portion thereof with a coupling part (52) fitted into the recess section (22).

Further, a lower end of an inner body pressing protrusion wheel (25) of the pump upper body (20) is configured to press a top surface of a connection piece (36) of the pump inner body (30).

In addition, the inner space of the pump inner body (30) is a contents temporary reservoir (TR) where the contents are temporarily stayed until the contents introduced through the contents inlet (13) are discharged through the contents outlet (23).

In the pump for discharging contents having the above configuration according to one embodiment of the present invention, when an upper surface of the pump upper body (20) is pushed to allow the pump upper body (20) to move down with respect to the pump main body (10), the inner body barrel (31) of the pump inner body (30) is folded while an elastic member (40) is compressed such that a volume of the contents temporary reservoir (TR) is reduced to generate a discharge pressure in the contents temporary reservoir (TR), so contents in the contents temporary reservoir (TR) are pressed to be output through the contents outlet (23) while pushing the dispensing valve blade (32) adhering to the dispensing valve protrusion wheel (24). At this time, the suction valve plate (34) is pushed by the discharging pressure of the contents temporary reservoir (TR) so that the contents inlet (12) is pressed to be closed.

In addition, as the pressure on the upper surface of the pump upper body (20) is removed, the pump upper body (20) lifts up by an elastic force of the elastic member (40) so that the upper side surface extension piece (38) of the pump inner body (30) together moves up, thereby unfolding the folded inner body barrel (31). Thus, the volume of the contents temporary reservoir (TR) is increased so that the vacuum pressure is generated in the contents temporary reservoir (TR) and the dispensing valve blade (32) adheres to the dispensing valve protrusion wheel (24) to close the contents outlet (23), and the suction valve plate (34) is lifted up due to the vacuum pressure in the contents temporary reservoir (TR) so that the contents inlet (13) is opened and contents in the container (V) are transferred into the contents temporary reservoir (TR). As the contents are transferred into the contents temporary reservoir (TR), the vacuum pressure in the contents temporary reservoir (TR) disappears and the suction valve plate (34) closes the contents inlet (13) due to the elasticity of the elastic piece (33).

Advantageous Effects

According to the present invention, the pump inner body serves as a pump cylinder as well as a suction valve and a dispensing valve, so the number of components can be minimized, so that the assembling productivity can be improved and the product cost can be reduced, thereby providing the pump for discharging contents having the high market competitiveness.

In addition, according to the present invention, the pump operation is performed by changing a volume of the contents temporary reservoir by folding and unfolding the inner body barrel of the pump inner body, so the pump has a short working stroke distance, so that the pump can be easily applied to a product such as a compact having a short height.

Further, the present invention can provide the pump for discharging contents, in which components making contact with the contents, such as a suction valve or a dispensing valve, are formed of materials durable against the chemical composition instead of metallic materials to prevent corrosion caused by the contents, thereby extending the product life cycle and preventing the contents from being spoiled caused by chemical reaction between the contents and the components.

BEST MODE

Mode for Invention

It should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation.

Figure 1:
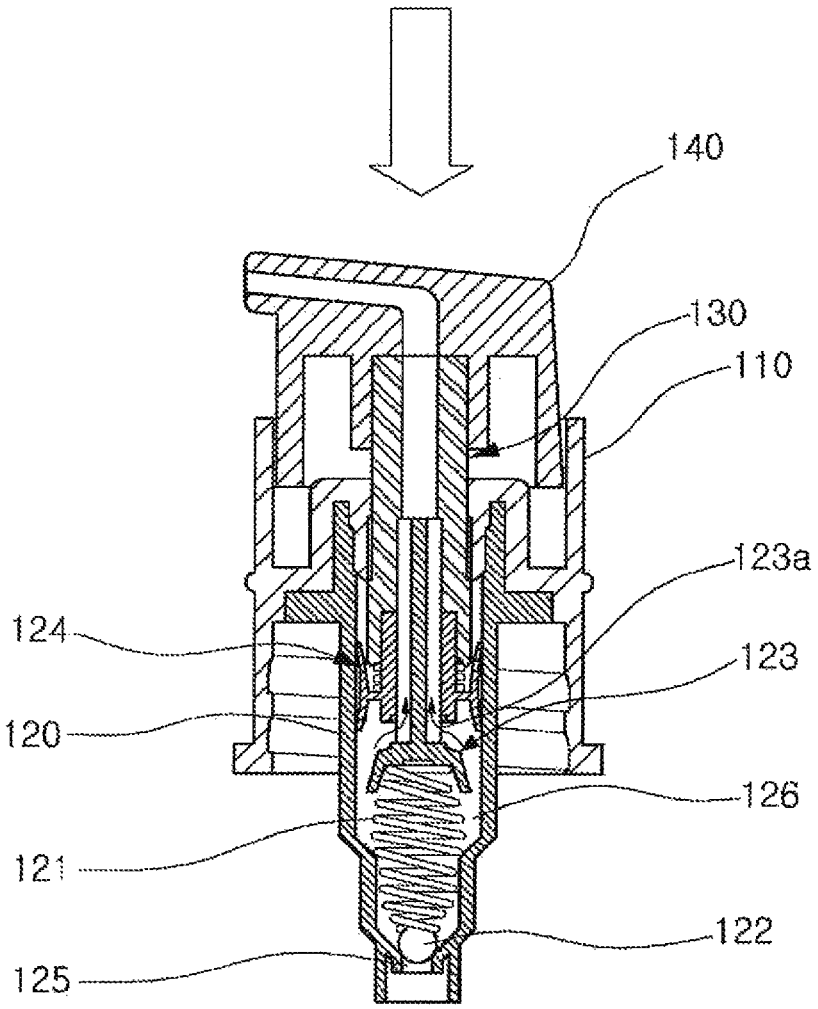
FIG. 1 is a view illustrating an exemplary state that a contents dispensing pump is operated to dispense contents according to the related art.
Figure 2:
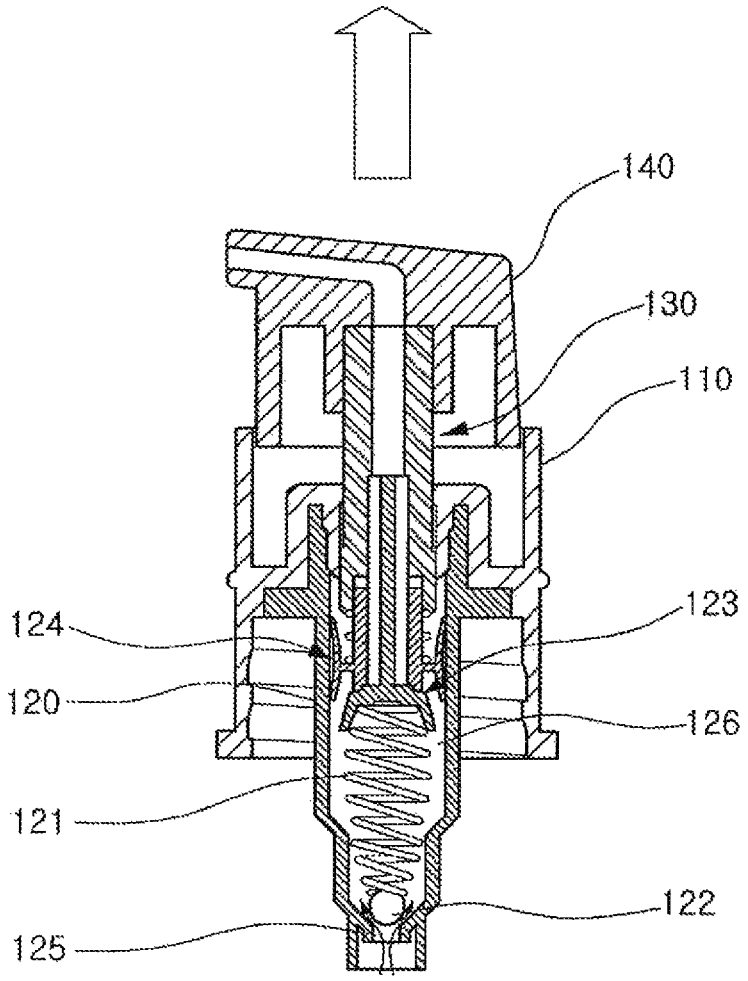
FIG. 2 is a view illustrating an exemplary state that a contents dispensing pump is restored to an original state when force is removed from the contents dispensing pump according to the related art.
Figure 3:
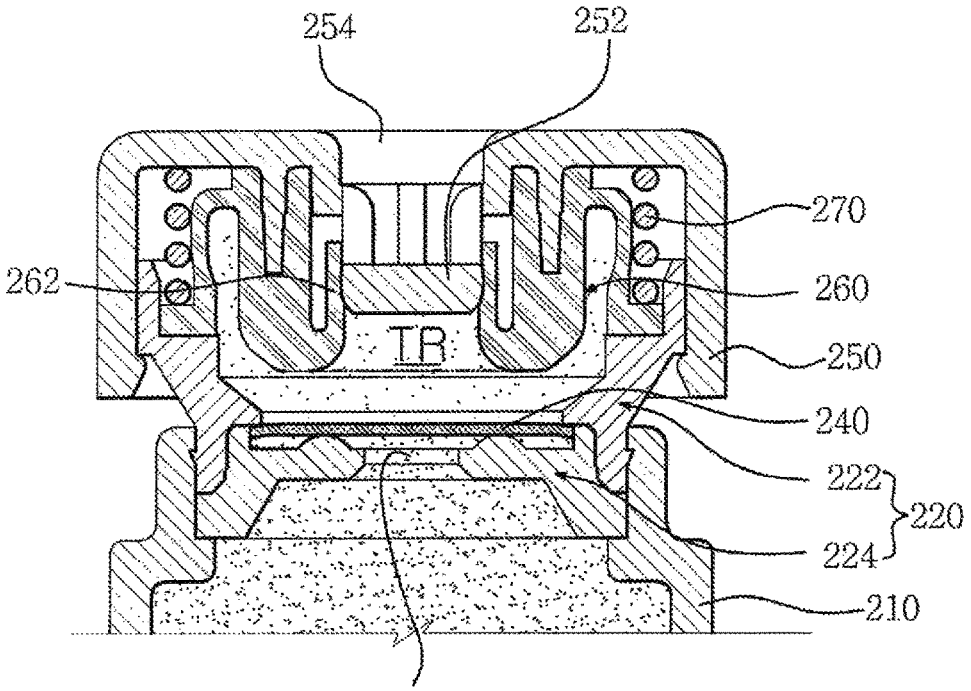
FIG. 3 is an assembled sectional view of a contents dispensing pump according to another example of the related art.
Figure 4:
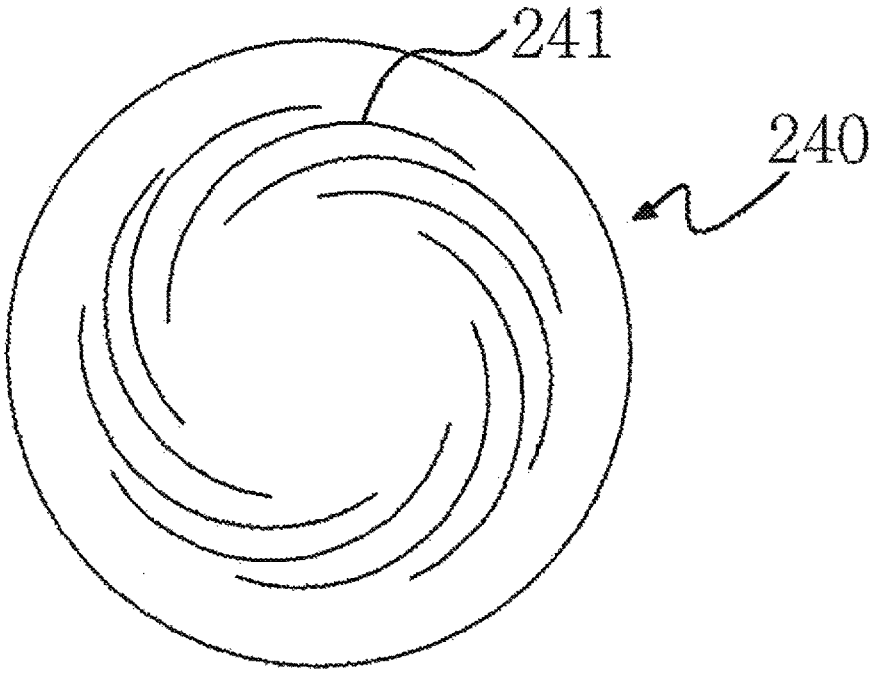
FIG. 4 is a plan view showing a valve plate of a contents dispensing pump according to still another example of the related art.
Figure 5:
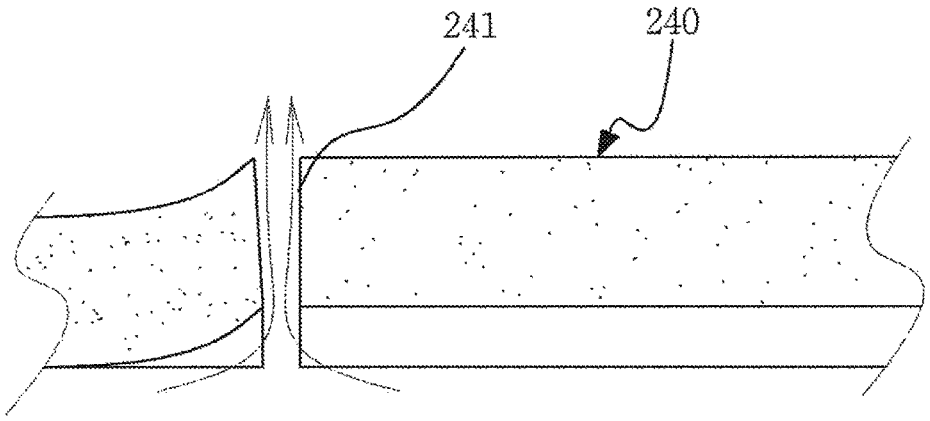
FIG. 5 is a sectional view showing an operating state of opening/closing lines of a valve plate applied to a contents dispensing pump according to still another example of the related art.
Figure 6:
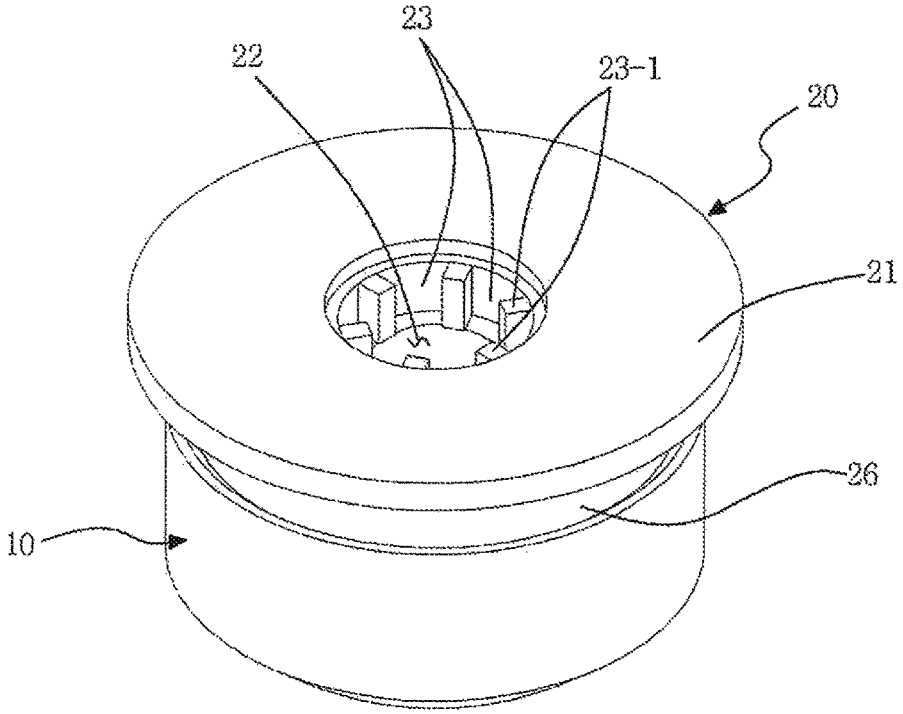
FIG. 6 is an assembled perspective view of a pump for discharging contents according to one embodiment of the present invention.
Figure 7:
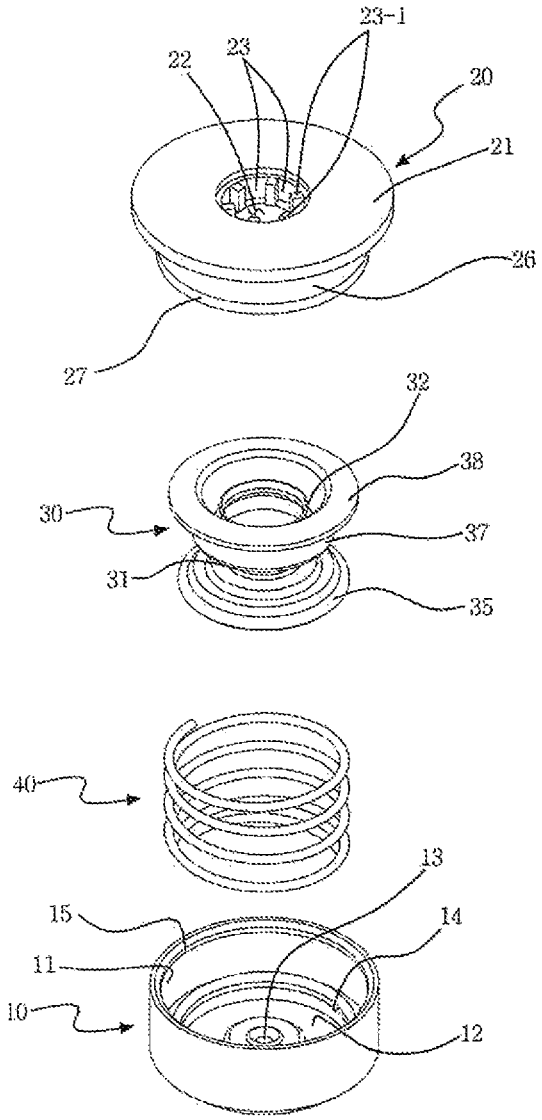
FIG. 7 is an exploded perspective view of a pump for discharging contents according to one embodiment of the present invention.
Figure 8:
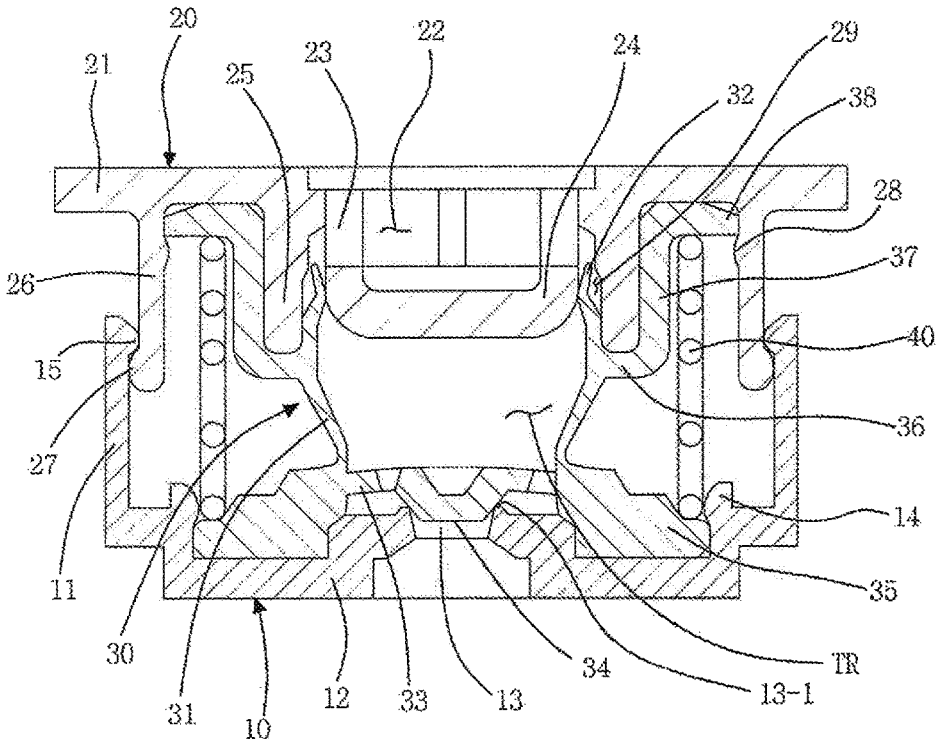
FIG. 8 is an assembled sectional view of a pump for discharging contents according to one embodiment of the present invention.
Figure 9:
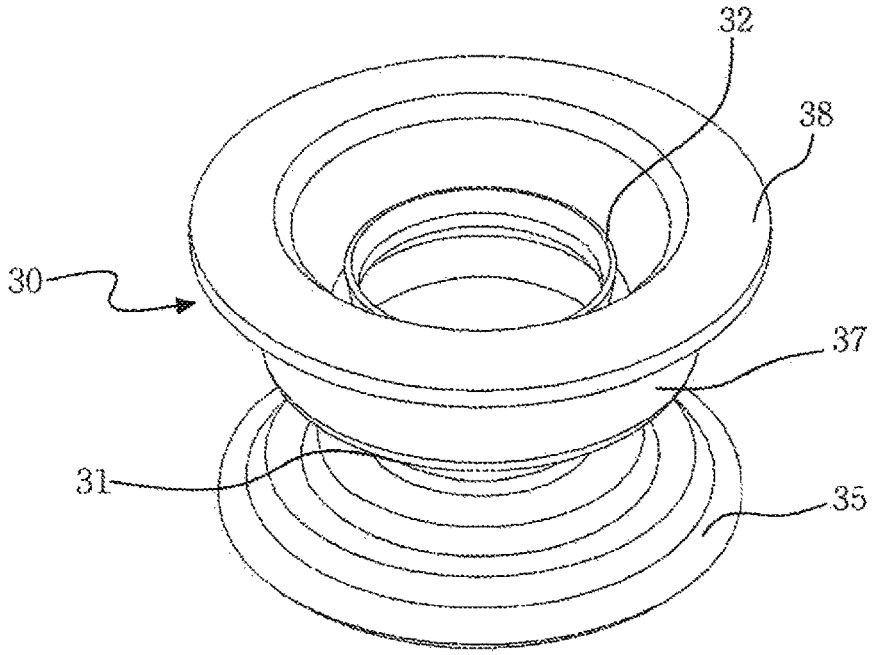
FIG. 9 is a perspective view of a pump inner body applied to the present invention.
Figure 10:
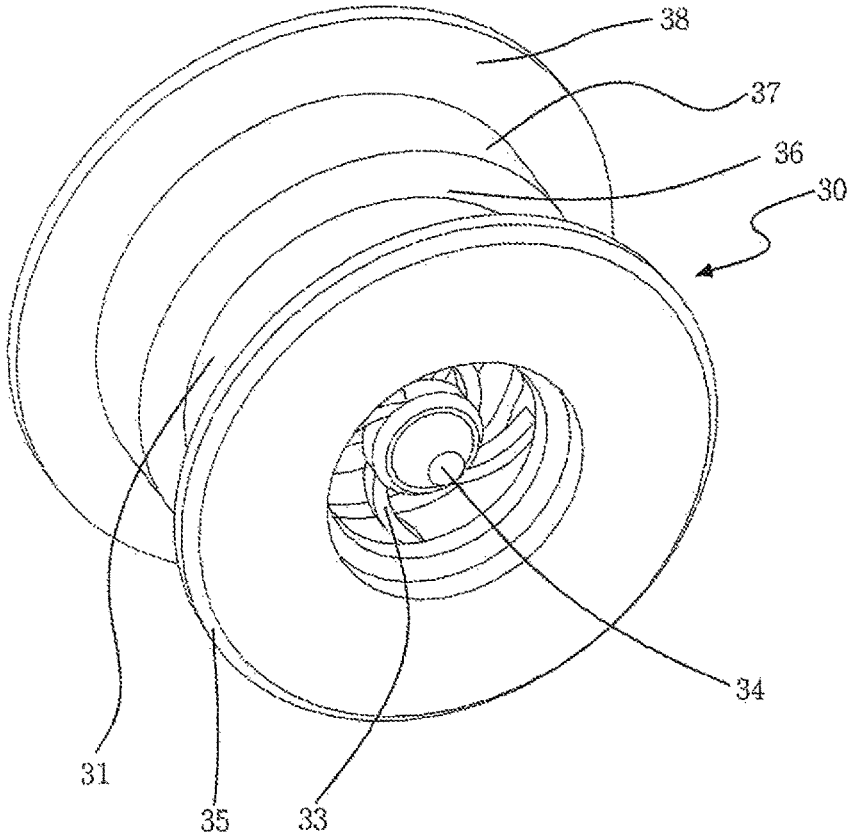
FIG. 10 is a bottom perspective view of a pump inner body applied to the present invention.

FIG. 6 is an assembled perspective view of a pump for discharging contents according to one embodiment of the present invention, FIG. 7 is an exploded perspective view of a pump for discharging contents according to one embodiment of the present invention, and FIG. 8 is an assembled sectional view of a pump for discharging contents according to one embodiment of the present invention. In addition, FIG. 9 is a perspective view of a pump inner body applied to the present invention and FIG. 10 is a bottom perspective view of a pump inner body applied to the present invention.

Hereinafter an embodiment of the present invention will be described in detail with reference to accompanying drawings.

As shown in FIGS. 6 to 10, a pump for discharging contents according to an embodiment of the present invention is coupled to a container V for containing the contents and includes a pump main body 10, a pump upper body 20, a pump inner body 30, and an elastic member 40.

The pump main body 10 includes a main body sidewall 11 and a main body lower plate 12. The pump main body 10 has a bowl shape where an upper portion is open and an inner portion is empty. The pump upper body 20 is coupled to an upper portion of the pump main body 10 and the pump inner body 30 is installed in the empty space in the pump main body 10.

A contents inlet 13 is formed at a center of a main body lower plate 12. An annular protrusion 13-1 is formed at an edge of the contents inlet 13 to improve airtightness between the contents inlet 13 and a suction valve plate 34 of the pump inner body 30.

The main body lower plate 12 is provided at an upper edge thereof with a first inner body latching sill 14 coupled with the pump inner body 30 and a lower side surface extension piece 35 of the pump inner body 30 is undercut-coupled with the first inner body latching sill 14.

The main body sidewall 11 is formed at an inner upper end thereof with a first latching sill 15 coupled with the pump upper body 20 to prevent the pump upper body 20 from being separated and the first latching sill 15 is undercut-coupled with a second latching sill 27 of the upper body sidewall 26 of the pump upper body 20.

The pump upper body 20 is coupled to an upper portion of the pump main body 10 to move up and down with respect to the pump main body 10. A contents outlet 23 is formed at a center of an upper body upper plate 21, a dispensing valve protrusion wheel 24 is formed under the contents outlet 23, and a connection port 23-1 is formed between the pump upper body 20 and the contents outlet 23 to connect the dispensing valve protrusion wheel 24 with the upper body upper plate 21.

Further, a recess section 22 having a bowl shape may be formed at a center of the pump upper body 20, the contents outlet 23 may be formed at an upper side portion of the recess section 22, and the dispensing valve protrusion wheel 24 may be formed under the contents outlet 23.

In addition, an inner body pressing protrusion wheel 25 is integrally formed under the upper body upper plate 21 while being spaced apart from the dispensing valve protrusion wheel 24 by a predetermined distance so that a valve blade operating space 29 is formed between the dispensing valve protrusion wheel 24 and the inner body pressing protrusion wheel 25.

An upper body sidewall 26 is integrally provided outward under the upper body upper plate 21. A second latching sill 27 is provided outward from a lower end of the upper body sidewall 26 and latched with the first latching sill 15 of the pump main body 10.

The upper body sidewall 26 of the pump upper body 20 is inserted into the main body sidewall 11 of the pump main body 10 and the second latching sill 27 of the upper body sidewall 26 is undercut-coupled with the main body sidewall 11 by passing over the first latching sill 15 of the main body sidewall 11 to prevent the pump upper body 20 from being separated from the pump main body 10.

Since the first latching sill 15 and the second latching sill 27 prevent the pump upper body 20 and the pump main body 10 from being separated from each other, it is also possible to insert the main body sidewall 11 of the pump main body 10 into the upper body sidewall 26 of the pump upper body 20 after forming the first latching sill 15 at an outer portion of the main body sidewall 11 of the pump main body 10 and the second latching sill 27 at an inner portion of the upper body sidewall 26 of the pump upper body 20, instead of inserting the upper body sidewall 26 of the pump upper body 20 into the main body sidewall 11 of the pump main body 10.

In addition, a second inner body latching sill 28 is provided at an upper inner portion of the upper body sidewall 26 and coupled with the pump inner body 30, so an upper side surface extension piece 38 of the pump inner body 30 is coupled with the second inner body latching sill 28.

The pump inner body 30 is coupled to insides of the pump main body 10 and the pump upper body 20, an inner body barrel 31 having a jar shape is formed at a center of the pump inner body 30, and a dispensing valve blade 32 is formed at an upper end of the pump inner body 30. The inner space of the inner body barrel 31 is a contents temporary reservoir TR where the contents are temporarily stayed until the contents introduced through the contents inlet 13 are discharged through the contents outlet 23.

Since the pump inner body 30 is repeatedly folded and unfolded, the pump inner body 30 is formed of a material having excellent elasticity. Preferably, the pump inner body 30 includes at least one of general rubber, elastomer, silicon rubber, NBR rubber, and synthetic resin having excellent elasticity and including polyethylene (PE) and polypropylene (PP).

Figure 19:
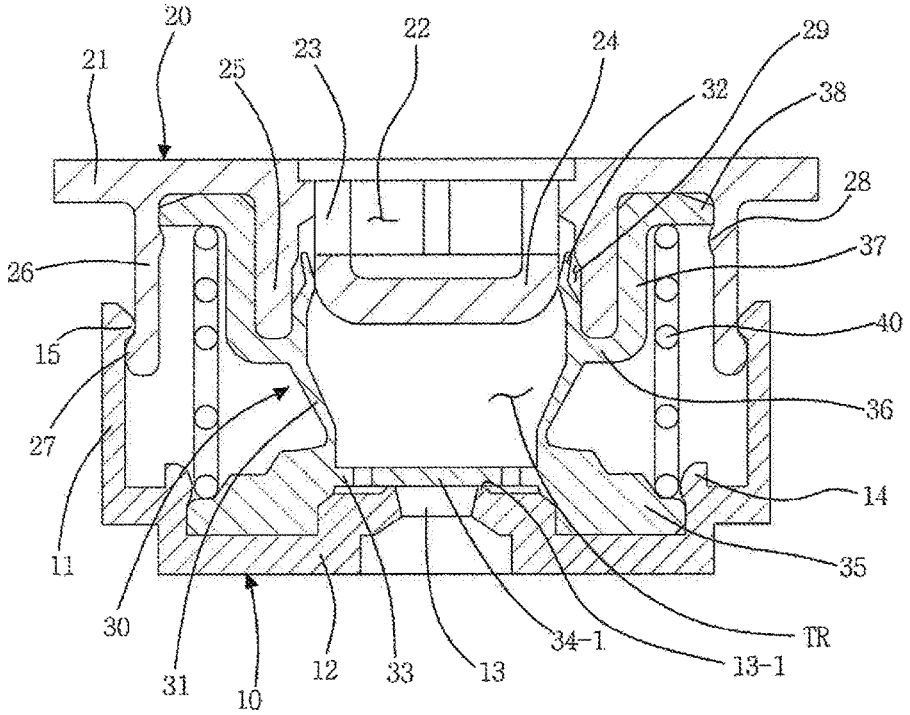
FIG. 19 is a sectional view showing a state that a pump inner body having a flat suction valve plate is coupled with a pump for discharging contents according to an embodiment of the present invention.
Figure 20:
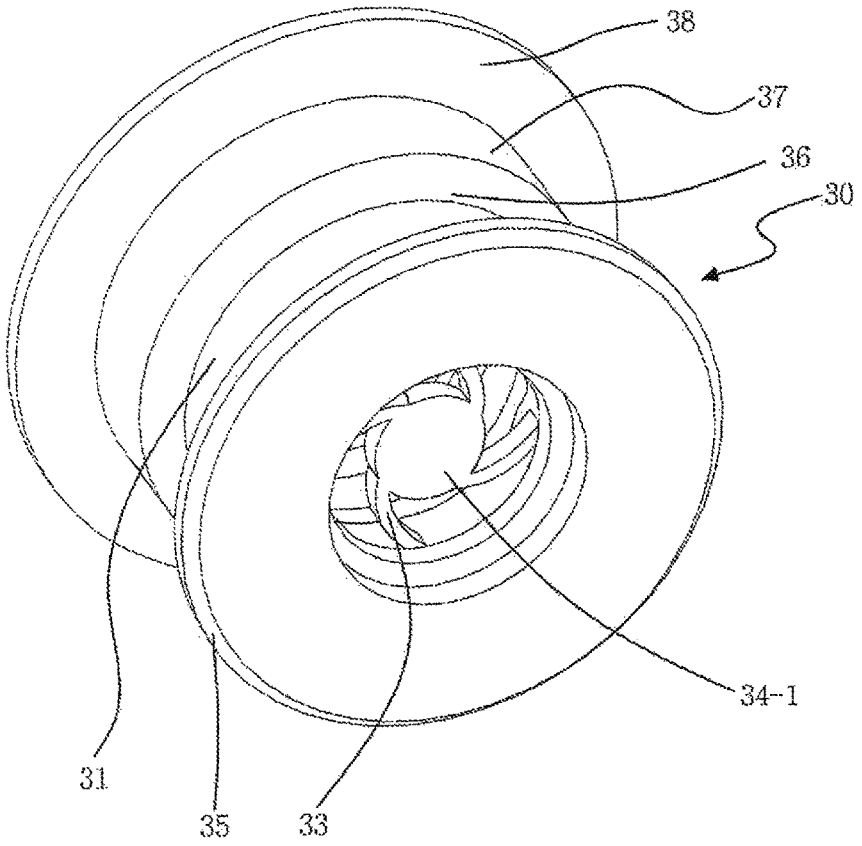
FIG. 20 is a bottom perspective view of a pump inner body having a flat suction valve plate applied to the present invention.

As shown in FIGS. 19 and 20, a flat suction valve plate 34-1 connected to an elastic piece 33 is provided to open or close the contents inlet 13 of the pump main body 10.

As shown in FIGS. 8 and 10, the flat suction valve plate 34-1 may include a suction valve plate 34 having an inverse trapezoidal cone shape protruding downward to improve airtightness with respect to the contents inlet 13.

In addition, a lower side surface extension piece 35 is provided at an outer lower portion of the inner body barrel 31, a connection piece 36 is integrally formed at an outer portion of the inner body barrel 31, an upper body coupling piece 37 is integrally formed upward from an outer end of the connection piece 36, and an upper side surface extension piece 38 is integrally formed at an outer upper end of the upper body coupling piece 37.

Further, a lower end of an inner body pressing protrusion wheel 25 of the pump upper body 20 is configured to press a top surface of a connection piece 36 of the pump inner body 30, and the upper side surface extension piece 38 of the pump inner body 30 is fitted between the upper body sidewall 26 of the pump upper body 20 and the inner body pressing protrusion wheel 25 and undercut-coupled by passing over the second inner body latching sill 28 of the upper body sidewall 26.

The elastic member 40 is mounted inside the pump main body 10 and the pump upper body 20 to elastically support between the pump main body 10 and the pump upper body 20. After the lower side surface extension piece 35 of the pump inner body 30 is coupled to the pump main body 10, one end of the elastic member 40 is mounted on the lower side surface extension piece 35 of the pump inner body 30. In addition, after the upper side surface extension piece 38 of the pump inner body 30 is coupled to the pump upper body 20, one end of the elastic member 40 is elastically supported on the upper side surface extension piece 38.

In detail, one side of the elastic member 40 elastically supports the pump main body 10 and the lower side surface extension piece 35 of the pump inner body 30, and the other side of the elastic member 40 elastically supports the pump upper body 20 and the upper side surface extension piece 38 of the pump inner body 30. Thus, as the pump upper body 20 is pressed against the pump main body 10, the upper side surface extension piece 38 of the pump inner body 30 moves down together with the pump upper body 20, so the inner body barrel 31 of the pump inner body 30 is folded, so that the volume of the temporary contents reservoir TR is reduced.

The elastic member 40 may include one of synthetic resin and a metallic material. Since the elastic member 40 is positioned inside the pump inner body 30, the elastic member 40 does not make direct-contact with the contents, so that contamination of the contents caused by the chemical reaction can be prevented and the durability of the elastic member 40 can be improved.

According to another embodiment of the present invention, an auxiliary dispensing valve member 50 may be coupled to the recess section 22 of the pump upper body 20.

Figure 13:
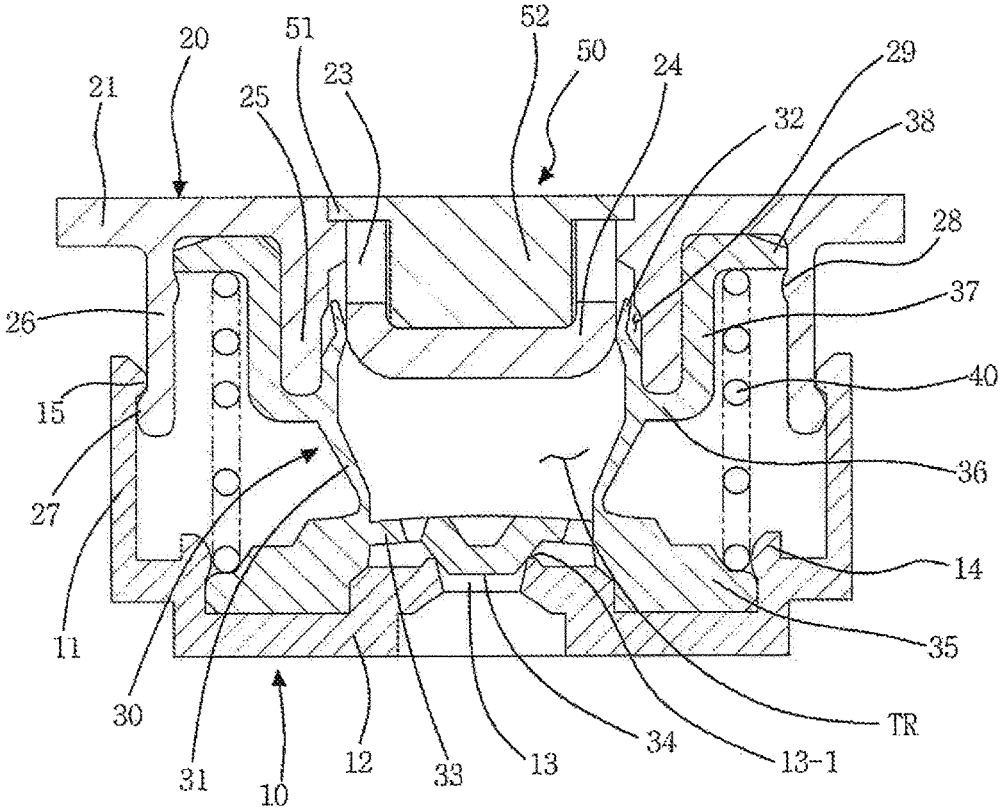
FIG. 13 is an assembled sectional view of a pump for discharging contents according to another embodiment of the present invention.

FIG. 13 is an assembled sectional view of a pump for discharging contents according to another embodiment of the present invention.

As shown in FIG. 13, the pump for discharging contents according to another embodiment of the present invention, which is coupled to a container V containing the contents to discharge the contents, includes a pump main body 10, a pump upper body 20, a pump inner body 30, an elastic member 40 and the auxiliary dispensing valve member 50.

In detail, the auxiliary dispensing valve member 50 is fitted with the recess section 22 of the pump for discharging contents according to an embodiment of the present invention.

The auxiliary dispensing valve member 50 is provided at an upper outer peripheral surface thereof with an auxiliary dispensing valve blade 51 and formed at a lower center portion thereof with a coupling part 52 fitted into the recess section 22.

Since the auxiliary dispensing valve blade 51 of the auxiliary dispensing valve member 50 needs to be repeatedly open and closed depending on the discharge of the contents, the auxiliary dispensing valve member 50 is formed of a material having excellent elasticity. Preferably, the auxiliary dispensing valve member 50 is formed of at least one of general rubber, elastomer, silicon rubber, NBR rubber, and synthetic resin having excellent elasticity and including polyethylene (PE) and polypropylene (PP).

Hereinafter, a method of assembling the pump for discharging contents having the above configuration according to the present invention will be described.

First, the pump inner body 30 is disposed inside the pump main body 10 and the lower side surface extension piece 35 of the pump inner body 30 is latched with the pump inner body latching sill 14 of the pump main body 10 through an undercut scheme, thereby fixing the pump inner body 30 to the pump main body 10.

At this time, the suction valve plate 34 or the flat suction valve plate 34-1 of the pump inner body 30 is closely mounted on the contents inlet 13 of the pump main body 10.

Then, the elastic member 40 is fitted between the lower side surface extension piece 35 and the upper side surface extension piece 38 of the pump inner body 30, and the upper side surface extension piece 38 of the pump inner body 30 is coupled between the upper body sidewall 26 and the inner body pressing protrusion wheel 25 of the pump upper body 20 such that the upper side surface extension piece 38 of the pump inner body 30 can be undercut-coupled with the second inner body latching sill 28 of the upper body sidewall 26.

After that, the upper body sidewall 26 of the pump upper body 20 is inserted into the main body sidewall 11 of the pump main body 10 such that the upper body sidewall 26 can be undercut-coupled with the first latching sill 15, thereby coupling the pump upper body 20 to the pump main body 10.

Hereinafter, the configuration of the pump for discharging contents according to the present invention, when the pump is applied to a compact container, will be described.

Figure 18:
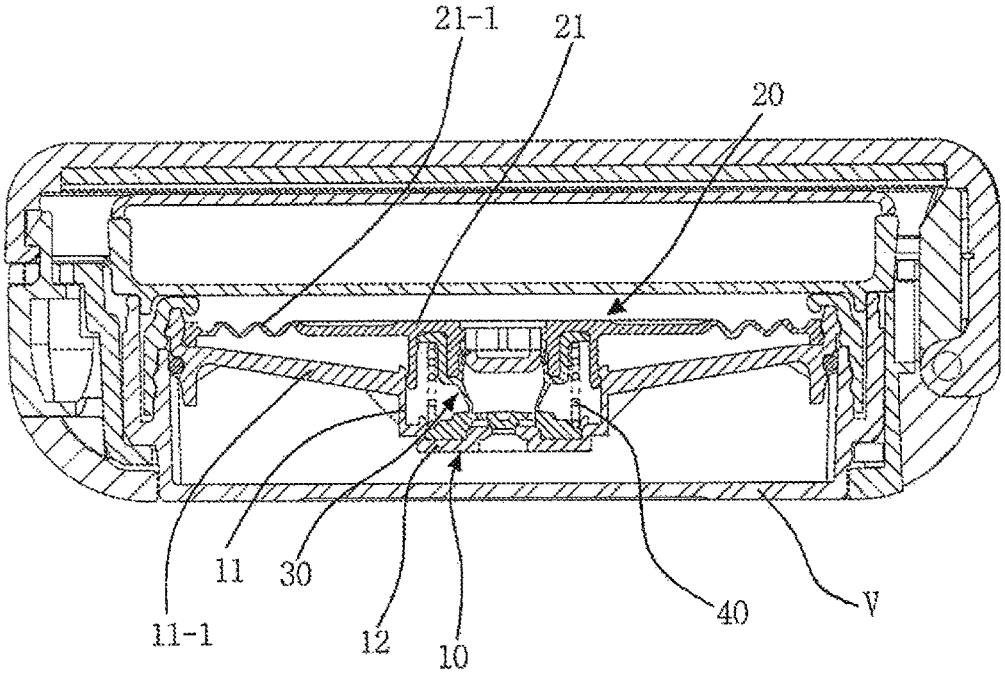
FIG. 18 is a sectional view showing a state that a pump for discharging contents is applied to a compact container according to an embodiment of the present invention.

FIG. 18 is a sectional view showing a state that the pump for discharging contents is applied to the compact container according to an embodiment of the present invention.

When the pump for discharging contents according to the present invention is applied to the compact container, a main body connecting extension piece 11-1 is integrally connected to the main body sidewall 11 of the pump main body 10, an upper body connecting extension piece 21-1 is integrally connected to the upper body upper plate 21 of the pump upper body 20, and the main body connecting extension piece 11-1 of the pump main body 10 and the upper body connecting extension piece 21-1 of the pump upper body 20 are coupled to the container V for containing the contents.

Figure 16:
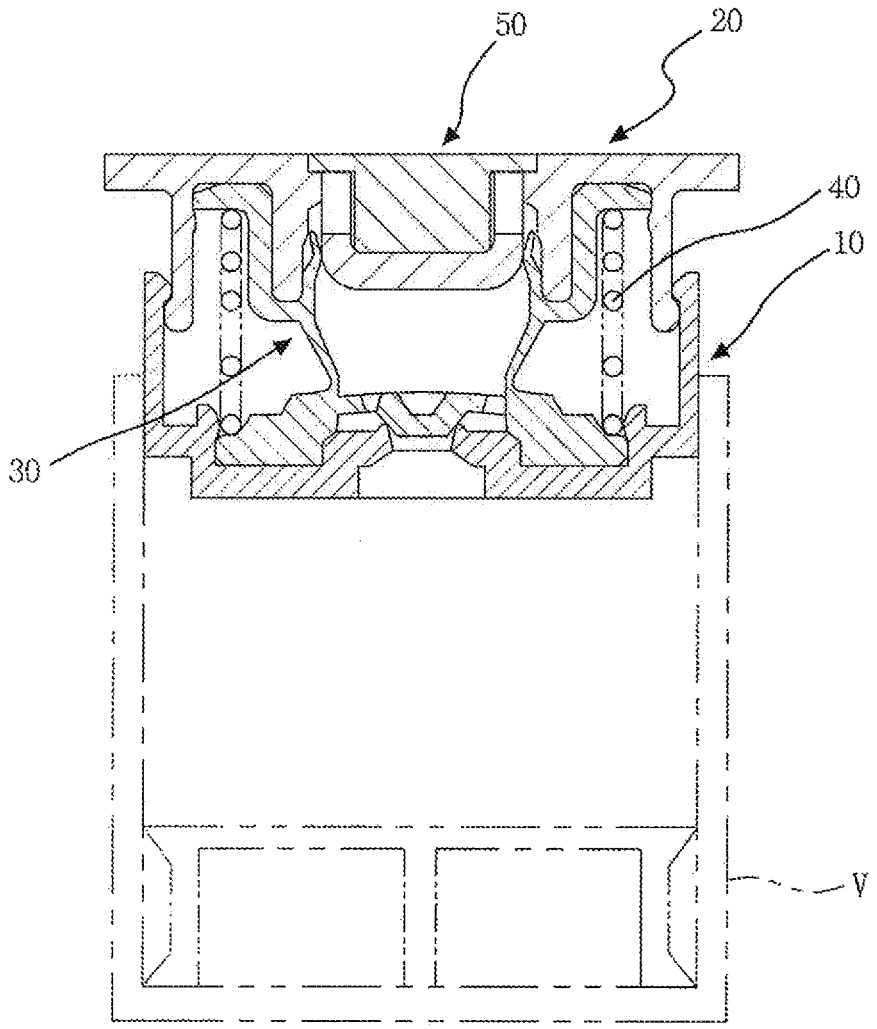
FIG. 16 is a sectional view showing a state that a pump for discharging contents is applied to a cosmetic cream container according to an embodiment of the present invention.
Figure 17:
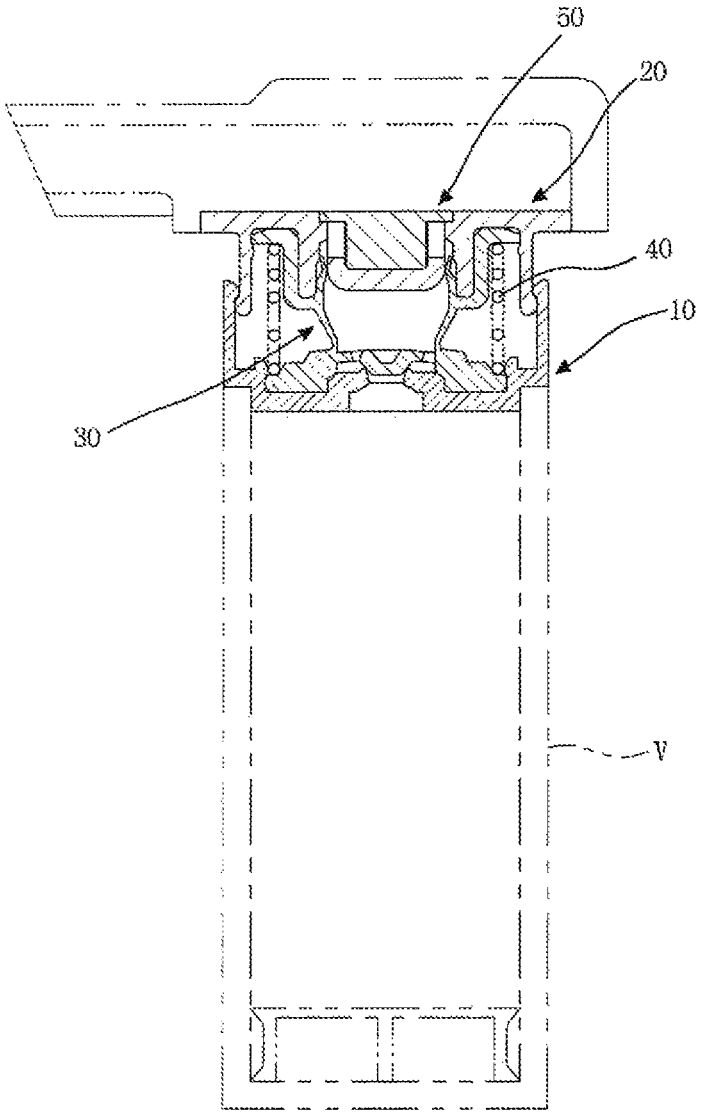
FIG. 17 is a sectional view showing a state that a pump for discharging contents is applied to a lotion container according to an embodiment of the present invention.

In addition, when the pump for discharging contents according to the present invention is applied to a cosmetic cream container or a lotion container, as shown in FIGS. 16 and 17, the pump for discharging contents according to the present invention is coupled to an opening of the cosmetic cream container or the lotion container in use.

Hereinafter, the operation of the pump for discharging contents having the above configuration according to the present invention will be described.

The pump for discharging contents having the above configuration according to one embodiment of the present invention is coupled with the contents container V in use. For instance, the pump can be used for a normal cosmetic container, a daily supply container, a food container or a medicine container and can be applied to a packaging container such as a compact cosmetic container having a height smaller than a width thereof.

Figure 11:
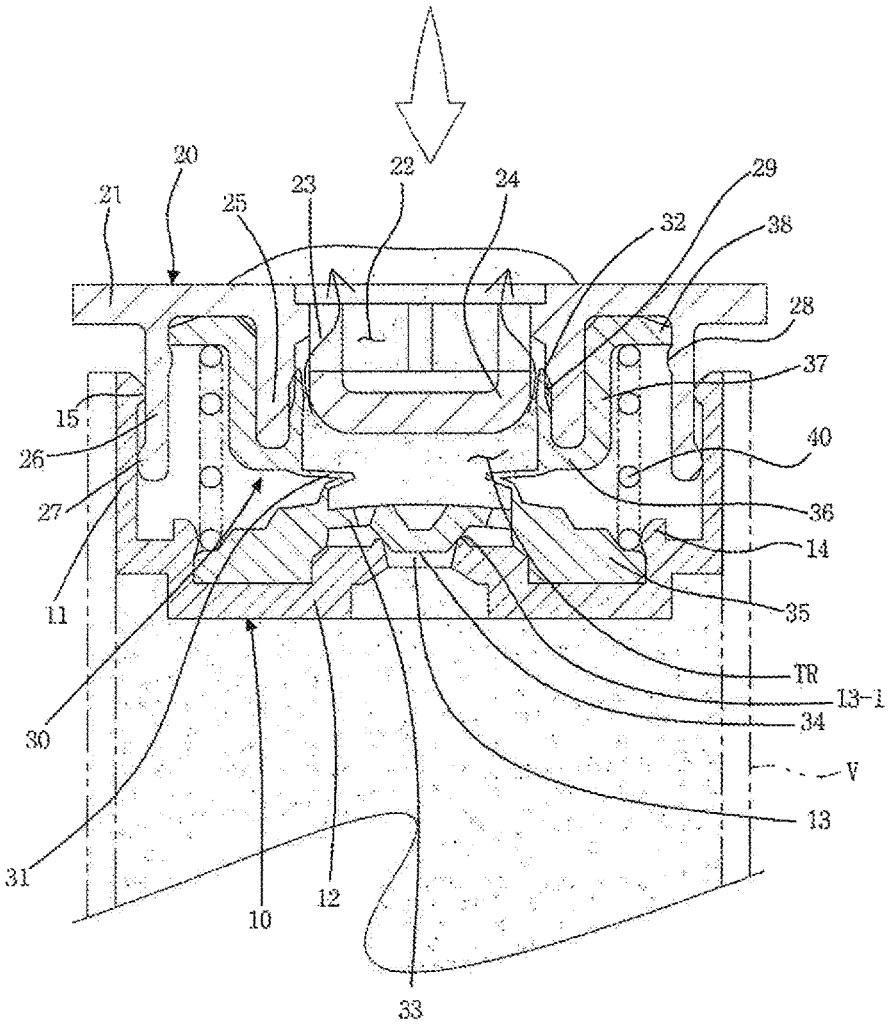
FIG. 11 is a sectional view showing a state that the pump for discharging contents is operated to discharge contents according to an embodiment of the present invention.

In the pump for discharging contents having the above configuration according to one embodiment of the present invention, as shown in FIG. 11, when an upper surface of the pump upper body 20 is pushed to allow the pump upper body 20 to move down with respect to the pump main body 10, the inner body barrel 31 of the pump inner body 30 is folded while the elastic member 40 is compressed such that a volume of the contents temporary reservoir TR is reduced to generate a discharge pressure in the contents temporary reservoir TR, so contents in the contents temporary reservoir TR are pressed to be output through the contents outlet 23 while pushing the dispensing valve blade 32 adhering to the dispensing valve protrusion wheel 24. At this time, the suction valve plate 34 is pushed by the discharging pressure of the contents temporary reservoir TR so that the contents inlet 12 is pressed to be closed.

Figure 12:
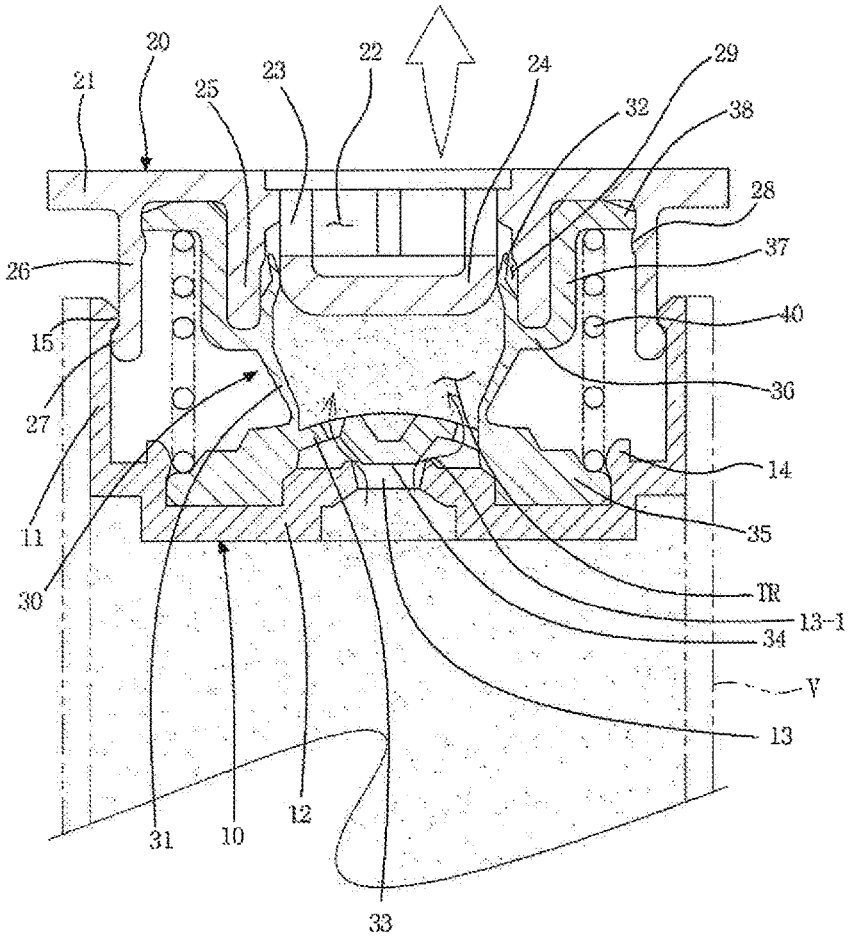
FIG. 12 is a sectional view showing a state that a pump for discharging contents is restored to an original state by removing force from the pump according to an embodiment of the present invention.

In addition, as shown in FIG. 12, when the pressure on an upper surface of the pump upper body 20 is removed, the pump upper body 20 lifts up by an elastic force of the elastic member 40 so that the upper side surface extension piece 38 of the pump inner body 30 together moves up, thereby unfolding the folded inner body barrel 31.

Therefore, the volume of the contents temporary reservoir TR is increased so that a vacuum pressure is generated in the contents temporary reservoir TR and the dispensing valve blade 32 adheres to the dispensing valve protrusion wheel 24 to close the contents outlet 23, and the suction valve plate 34 is lifted up due to the vacuum pressure in the contents temporary reservoir TR so that the contents inlet 13 is opened and contents in the container V are transferred into the contents temporary reservoir TR. As the contents are transferred into the contents temporary reservoir TR, the vacuum pressure in the contents temporary reservoir TR disappears and the contents inlet 13 is closed by the suction valve plate 34 due to elasticity of the elastic piece 33.

Hereinafter, the operation of the pump for discharging contents having the above configuration according to another embodiment of the present invention will be described.

Figure 14:
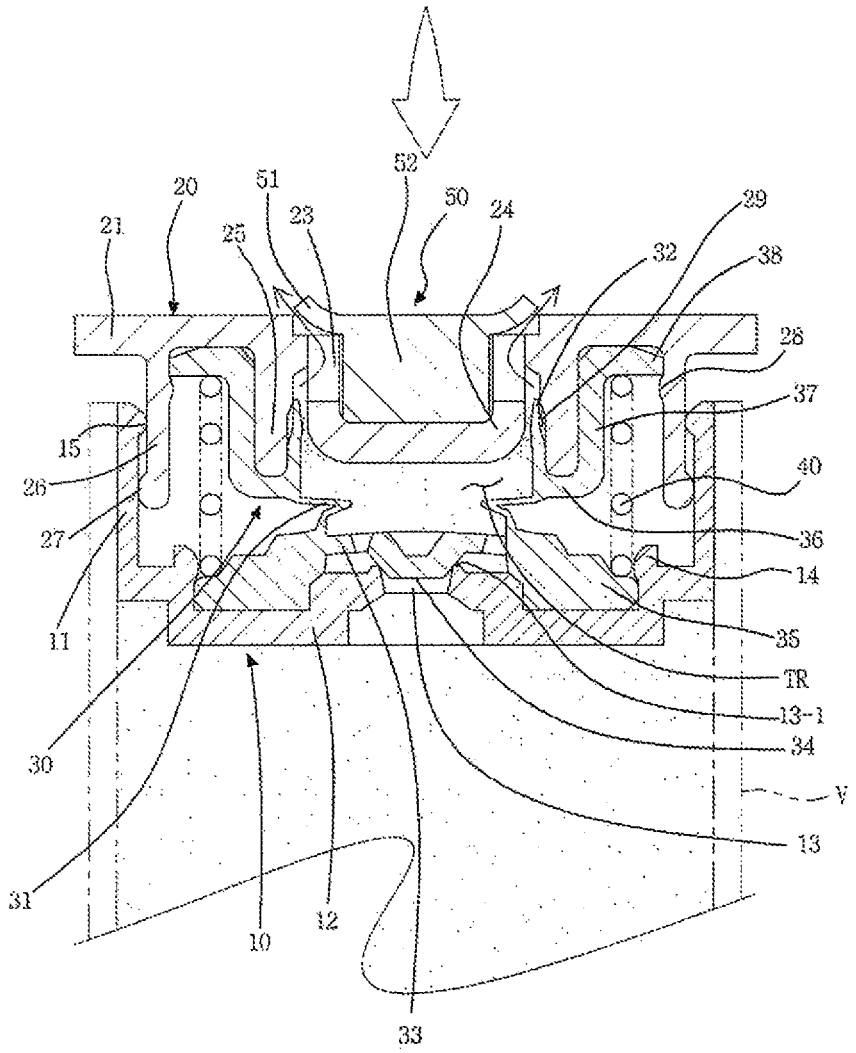
FIG. 14 is a sectional view showing a state that the pump for discharging contents is operated to discharge contents according to another embodiment of the present invention.

In the pump for discharging contents according to another embodiment of the present invention, the auxiliary dispensing valve member 50 is coupled to the recess section 22 of the pump upper body 20. As shown in FIG. 14, when an upper surface of the pump upper body 20 is pushed to allow the pump upper body 20 to move down with respect to the pump main body 10, the inner body barrel 31 of the pump inner body 30 is folded while the elastic member 40 is compressed such that a volume of the contents temporary reservoir TR is reduced to generate a discharge pressure in the contents temporary reservoir TR, so contents in the contents temporary reservoir TR are pressed to be output through the contents outlet 23 while pushing the dispensing valve blade 32 adhering to the dispensing valve protrusion wheel 24 and pushing the auxiliary dispensing valve blade 51 of the auxiliary dispensing valve member 50. At this time, the suction valve plate 34 is pushed by the discharging pressure of the contents temporary reservoir TR so that the contents inlet 12 is pressed to be closed.

Figure 15:
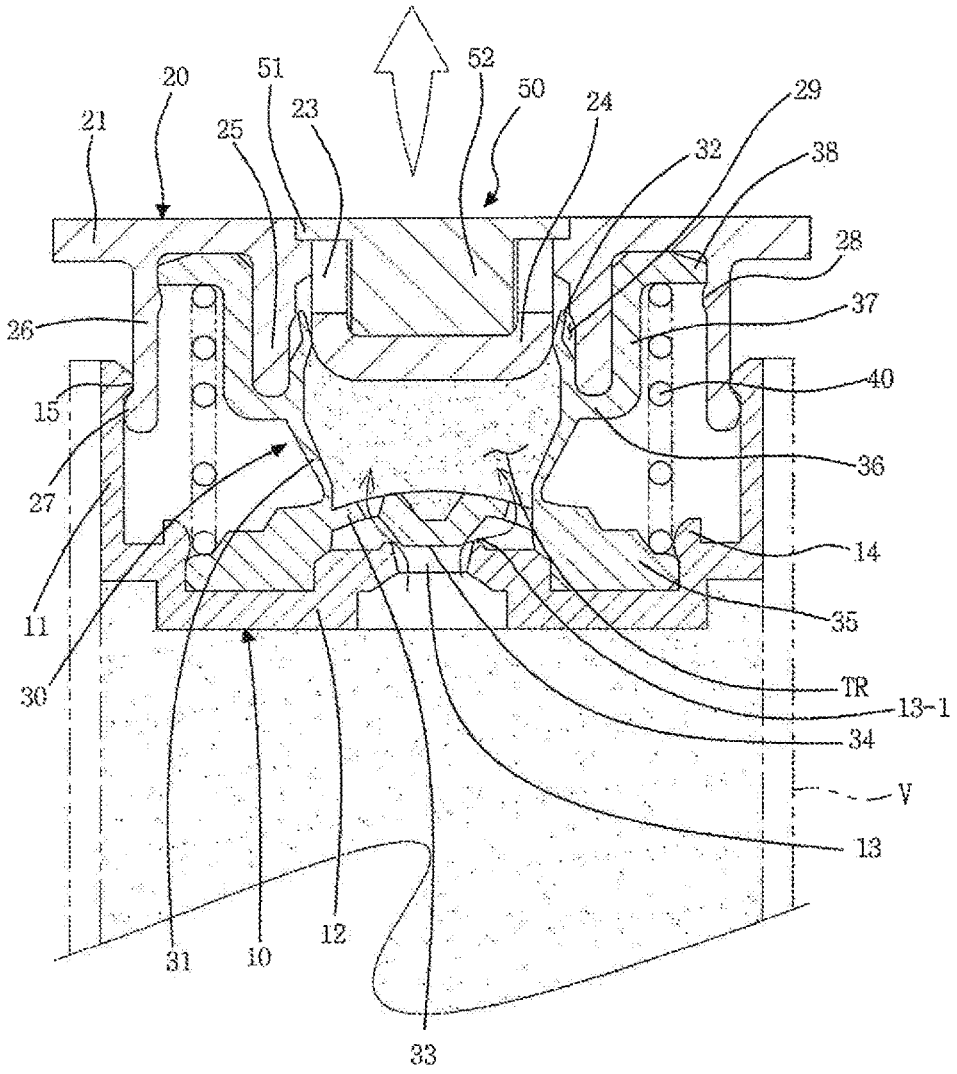
FIG. 15 is a sectional view showing a state that a pump for discharging contents is restored to an original state by removing force from the pump according to another embodiment of the present invention.

In addition, as shown in FIG. 15, when the pressure on an upper surface of the pump upper body 20 is removed, the pump upper body 20 lifts up by an elastic force of the elastic member 40 so that the upper side surface extension piece 38 of the pump inner body 30 together moves up, thereby unfolding the folded inner body barrel 31. Therefore, the volume of the contents temporary reservoir TR is increased so that a vacuum pressure is generated in the contents temporary reservoir TR and the dispensing valve blade 32 adheres to the dispensing valve protrusion wheel 24 to close the contents outlet 23. At this time, since the auxiliary dispensing valve blade 51 of the auxiliary dispensing valve member 50 is not subject to the discharging pressure any more, the auxiliary dispensing valve blade 51 returns to the original position due to the elasticity of the material constituting the auxiliary dispensing valve member 50, so that the contents outlet 23 is closed.

In addition, as the inner body barrel 31 of the pump inner body 30 is unfolded, the suction valve plate 34 is lifted up due to the vacuum pressure in the contents temporary reservoir TR so that the contents inlet 13 is opened and contents in the container V are transferred into the contents temporary reservoir TR. As the contents are transferred into the contents temporary reservoir TR, the vacuum pressure in the contents temporary reservoir TR disappears and the contents inlet 13 is closed by the suction valve plate 34 due to elasticity of the elastic piece 33.

The pump for discharging contents described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: pump main body
11: main body sidewall
12: main body lower plate
13: contents inlet
14: first inner body latching sill
15: first latching sill
20: pump upper body
21: upper body upper plate
22: recess section
23: contents outlet
24: dispensing valve protrusion wheel

25: inner body pressing protrusion wheel
26: upper body sidewall
27: second latching sill
28: second inner body latching sill
30: pump inner body
31: inner body barrel
32: dispensing valve blade
33: elastic plate
34: suction valve plate
35: lower side surface extension piece
36: connection piece
37: upper body coupling piece
38: upper side surface extension piece
40: elastic member
50: auxiliary dispensing valve member
51: auxiliary dispensing valve blade
52: coupling part

The invention claimed is:

1. A pump for discharging contents, which is coupled to a container for containing contents therein to dispense the contents, the pump comprising:

a pump main body (10);

a pump upper body (20);

a pump inner body (30); and an elastic member (40), wherein the pump main body (10) includes a main body sidewall (11) and a main body lower plate (12) and a contents inlet (13) is formed at a center of the main body lower plate (12), the pump upper body (20) is coupled to an upper portion of the pump main body (10) to move up and down with respect to the pump main body (10), a recess section (22) is formed at a center of an upper body upper plate (21), a contents outlet (23) is formed at an upper side portion of the recess section (22), and a dispensing valve protrusion wheel (24) is formed at a lower side portion of the recess section (22), the pump inner body (30) is coupled to insides of the pump main body (10) and the pump upper body (20), an inner body barrel (31) is formed at a center of the pump inner body (30), a dispensing valve blade (32) is formed at an upper end of the pump inner body (30), and a suction valve plate (34) or a flat suction valve plate (34-1) connected to an elastic piece (33) is formed at a lower inner side of the inner body barrel (31), and the elastic member (40) is mounted inside the pump main body (10) and the pump upper body (20).

2. The pump of claim 1, wherein the pump main body (10) is provided with a first latching sill (15) formed at an inner upper end of the main body sidewall (11) and coupled to the pump upper body (20) to prevent the pump upper body (20) from being separated.

3. The pump of claim 1, wherein an inner body pressing protrusion wheel (25) is formed under the upper body upper plate (21) while being spaced apart from the dispensing valve protrusion wheel (24) by a predetermined distance.

4. The pump of claim 3, wherein a valve blade operating space (29) is formed between the dispensing valve protrusion wheel (24) and the inner body pressing protrusion wheel (25).

5. The pump of claim 1, further comprising an upper body sidewall (26) provided outward under the upper body upper plate (21); and a second latching sill (27) provided outward from a lower end of the upper body sidewall (26) and latched with a first latching sill (15) of the pump main body (10).

6. The pump of claim 1, wherein the recess section (22) is formed at a center of the upper body upper plate (21) of the pump upper body (20), the contents outlet (23) is formed at an upper side surface of the recess section (22), and the dispensing valve protrusion wheel (24) is formed under the contents outlet (23).

7. The pump of claim 1, wherein a connection piece (36) is formed at an outer portion of the inner body barrel (31), an upper body coupling piece (37) extends upward from an outer end of the connection piece (36), and an upper side surface extension piece (38) is formed at an outer upper end of the upper body coupling piece (37).

8. The pump of claim 1, wherein the elastic member (40) elastically supports between the pump main body (10) and the pump upper body (20), one end of the elastic member (40) is elastically supported on a lower side surface extension piece (35) of the pump inner body (30) in the pump main body (10), and one end of the elastic member (40) is elastically supported on an upper side surface extension piece (38) of the pump inner body (30) in the pump upper body (20).

9. The pump of claim 1, wherein a lower end of an inner body pressing protrusion wheel (25) of the pump upper body (20) is configured to press a top surface of a connection piece (36) of the pump inner body (30).

10. A pump for discharging contents, which is coupled to a container for containing contents therein to dispense the contents, wherein a pump inner body (30) is positioned inside a pump main body (10), a suction valve plate (34) or a flat suction valve plate (34-1) of the pump inner body (30) is closely mounted on a contents inlet (13) of the pump main body (10), an elastic member is fitted between a lower side surface extension piece (35) and an upper side surface extension piece (38) of the pump inner body (30), the upper side surface extension piece (38) of the pump inner body (30) is coupled between an upper body sidewall (26) of a pump upper body (20) and an inner body pressing protrusion wheel (25), and the upper body sidewall (26) of the pump upper body (20), which is formed with a recess section (22) having a contents outlet (23), is inserted into a main body sidewall (11) of the pump main body (10) so that a second latching sill (27) of the upper body sidewall (26) is undercut-coupled with a first latching sill (15) of the main body sidewall (11) to couple the pump upper body (20) to the pump main body (10).

11. The pump of claim 10, wherein the pump main body (10) includes a main body connection extension piece (11-1) extending from the main body sidewall (11), the pump upper body (20) includes an upper body connection extension piece (21-1) extending from an upper body upper plate (21), and the main body connection extension piece (11-1) and the upper body connection extension piece (21-1) are coupled to the container for containing the contents therein.

12. The pump of claim 10, wherein the pump main body (10) includes a main body connection extension piece (11-1) extending from the main body sidewall (11), the pump upper body (20) includes an upper body connection extension piece (21-1) extending from an upper body upper plate (21), and the main body connection extension piece (11-1) and the upper body connection extension piece (21-1) are coupled to the container for containing the contents therein.

13. A pump for discharging contents, which is coupled to a container for containing contents therein to dispense the contents, wherein, when an upper surface of a pump upper body (20) is pushed to allow the pump upper body (20) to move down with respect to a pump main body (10), an inner body barrel (31) of a pump inner body (30) is folded while an elastic member (40) is compressed such that a volume of a contents temporary reservoir (TR) is reduced to generate a discharge pressure in the contents temporary reservoir (TR), so contents in the contents temporary reservoir (TR) are pressed to be output through a contents outlet (23) while pushing a dispensing valve blade (32) adhering to a dispensing valve protrusion wheel (24), and a suction valve plate (34) or a flat suction valve plate (34-1) is pushed by the discharging pressure of the contents temporary reservoir (TR) so that a contents inlet (12) is pressed to be closed.

14. A pump for discharging contents, which is coupled to a container for containing contents therein to dispense the contents, wherein, when a pressure on an upper surface of a pump upper body (20) is removed, the pump upper body (20) lifts up by an elastic force of an elastic member (40) so that an upper side surface extension piece (38) of a pump inner body (30) and the pump upper body move up together, thereby unfolding a folded inner body barrel (31), so a volume of a contents temporary reservoir (TR) is increased so that a vacuum pressure is generated in the contents temporary reservoir (TR) and a dispensing valve blade (32) adheres to a dispensing valve protrusion wheel (24) to close a contents outlet (23), and a suction valve plate (34) or a flat suction valve plate (34-1) is lifted up due to the vacuum pressure in the contents temporary reservoir (TR) so that a contents inlet (13) is opened and contents in the container (V) are transferred into the contents temporary reservoir (TR).

* * * * *